US012258975B2

(12) United States Patent
Takemoto et al.

(10) Patent No.: US 12,258,975 B2
(45) Date of Patent: Mar. 25, 2025

(54) IMPELLER AND CENTRIFUGAL FAN

(71) Applicant: Nidec Corporation, Kyoto (JP)

(72) Inventors: Shinji Takemoto, Kyoto (JP); Satoshi Kajikawa, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 118 days.

(21) Appl. No.: 17/914,422

(22) PCT Filed: Feb. 26, 2021

(86) PCT No.: PCT/JP2021/007282

§ 371 (c)(1),
(2) Date: Sep. 26, 2022

(87) PCT Pub. No.: WO2021/199810

PCT Pub. Date: Oct. 7, 2021

(65) Prior Publication Data

US 2023/0109395 A1 Apr. 6, 2023

(30) Foreign Application Priority Data

| | | |
|---|---|---|
| Mar. 30, 2020 | (JP) | 2020-059389 |
| Mar. 30, 2020 | (JP) | 2020-059469 |
| Mar. 30, 2020 | (JP) | 2020-059603 |
| Mar. 30, 2020 | (JP) | 2020-059646 |

(51) Int. Cl.
*F04D 29/30* (2006.01)
*F04D 29/44* (2006.01)

(52) U.S. Cl.
CPC ..... *F04D 29/30* (2013.01); *F04D 29/444* (2013.01)

(58) Field of Classification Search
CPC ..... F04D 29/30; F04D 29/444; F04D 29/281; F05D 2240/301
See application file for complete search history.

(56) References Cited

U.S. PATENT DOCUMENTS

| | | | | |
|---|---|---|---|---|
| 3,574,480 | A * | 4/1971 | Hoepfner | F04D 29/30 415/218.1 |
| 7,134,839 | B2 * | 11/2006 | Horng | F04D 25/166 415/206 |
| 2002/0094271 | A1 * | 7/2002 | Yeuan | F04D 19/002 416/243 |
| 2004/0208746 | A1 * | 10/2004 | Crocker | F04D 25/0613 416/183 |
| 2006/0269406 | A1 * | 11/2006 | Cho | F04D 25/08 415/220 |

(Continued)

FOREIGN PATENT DOCUMENTS

| | | | | |
|---|---|---|---|---|
| CN | 110107514 | A * | 8/2019 | F04D 17/16 |
| JP | 4631867 | B2 | 2/2011 | |
| WO | WO-2006126408 | A1 * | 11/2006 | F04D 29/281 |

OTHER PUBLICATIONS

Official Communication issued in International Patent Application No. PCT/JP2021/007282, mailed on Apr. 20, 2021.

*Primary Examiner* — Woody A Lee, Jr.
*Assistant Examiner* — Eric A Lange
(74) *Attorney, Agent, or Firm* — Keating & Bennett, LLP

(57) ABSTRACT

An impeller for a centrifugal fan rotatable about a central axis extending in an axial direction includes a hub portion expanding radially outward about the central axis, and wings on a radially outer side of the hub portion. A cross-sectional shape of the wing in a circumferential direction is a wing shape.

9 Claims, 10 Drawing Sheets

(56) References Cited

U.S. PATENT DOCUMENTS

| | | | | |
|---|---|---|---|---|
| 2007/0036651 | A1* | 2/2007 | Lee | F04D 29/384<br>416/23 |
| 2010/0189557 | A1* | 7/2010 | Broom | F04D 29/281<br>415/203 |
| 2016/0290358 | A1* | 10/2016 | Hayamitsu | F04D 29/281 |
| 2018/0058468 | A1 | 3/2018 | Yanagisawa et al. | |

* cited by examiner

| | | | RADIUS (mm) | |
|---|---|---|---|---|
| | | | 1.45 | 7.25 |
| | | | ANGLE (deg) | |
| INNER DIAMETER | AIR FLOW AREA | NUMBER OF WINGS | INNER SIDE | OUTER SIDE |
| CONSTANT | CONSTANT | 11 | 15.5 | 28.4 |
| | | 13 | 18.4 | 33.2 |
| | | 15 | 21.5 | 37.6 |
| | | 17 | 22.4 | 38.9 |

IMPELLER AND CENTRIFUGAL FAN

CROSS-REFERENCE TO RELATED APPLICATIONS

This is a U.S. national stage of application No. PCT/JP2021/007282, filed on Feb. 26, 2021, and with priority under 35 U.S.C. § 119(a) and 35 U.S.C. § 365(b) being claimed from Japanese Patent Application No. 2020-059603, filed on Mar. 30, 2020, Japanese Patent Application No. 2020-059389, filed on Mar. 30, 2020, Japanese Patent Application No. 2020-059469, filed on Mar. 30, 2020, and Japanese Patent Application No. 2020-059646, filed on Mar. 30, 2020, the entire disclosures of which are hereby incorporated herein by reference.

1. FIELD OF THE INVENTION

The present disclosure relates to an impeller and a centrifugal fan.

2. BACKGROUND

In electronic devices such as a smartphone, heat generation is increasing with improvement in performance. When temperature of the electronic device becomes high, operation may become unstable. Therefore, it is important to cool the electronic device. Conventionally, a configuration in which air is blown by a fan for cooling is known.

As a fan that blows air, there is known a centrifugal fan having a plurality of blade portions extending radially outward from a hub portion located at a rotation center, in which a protruding portion is provided on a surface of the blade portion in a rotation direction in an attempt to reduce noise.

In a downsized electronic device, many electronic components are arranged in a small space, and a fan capable of supplying large maximum air volume together with large maximum static pressure is desired for air blowing for cooling. In the conventional centrifugal fan, there has been room for improvement in realizing large maximum static pressure and large maximum air volume.

SUMMARY

According to an example embodiment of the present disclosure, an impeller of a centrifugal fan rotatable about a central axis extending in an axial direction includes a hub portion expanding radially outward about the central axis, and a plurality of wings on a radially outer side of the hub portion. A cross-sectional shape of the wing in a circumferential direction is a wing shape.

The above and other elements, features, steps, characteristics and advantages of the present disclosure will become more apparent from the following detailed description of the example embodiments with reference to the attached drawings.

DETAILED DESCRIPTION

Hereinafter, motors according to example embodiments of the present disclosure will be described with reference to the accompanying drawings. In the following drawings, each structure may be different in contraction scale, number, or the like from an actual structure for easy understanding of each configuration.

Further, the drawings illustrate an XYZ coordinate system as an appropriate three-dimensional orthogonal coordinate system. In the XYZ coordinate system, a Y-axis direction is assumed to be a direction parallel to an axial direction of a central axis J illustrated in FIG. 1. The central axis J is a rotation axis of an impeller 20. An X-axis direction is a direction orthogonal to the central axis J and orthogonal to a side provided with an exhaust port 52 among sides of a case 50. A Z-axis direction is a direction orthogonal to both the X-axis direction and the Y-axis direction. In any of the X-axis direction, the Y-axis direction, and the Z-axis direction, an arrow in each drawing indicates a positive side and the side opposite to the positive side is a negative side.

In description below, the positive side of the Y-axis direction (+Y side) is referred to as the "front side" or "first side", and the negative side of the Y-axis direction (−Y side) is referred to the "rear side" or "second side". The rear side (second side) and the front side (first side) are names used only for description and do not limit an actual positional relationship and direction. Unless otherwise particularly stated, a direction parallel to the central axis J (Y-axis direction) is simply referred to as the "axial direction", a radial direction with the central axis J as the center is simply referred to as the "radial direction", and a circumferential direction around the central axis J, that is, a direction around the central axis J is simply referred to as the "circumferential direction". The side toward the central axis J in the radial direction is referred to as the "radially inside", and the side away from the central axis J is referred to as the "radially outside".

Note that, in the present description, to "extend or expand axially" includes not only a case of strictly extending or expanding in the axial direction (Y-axis direction) but also a case of extending or expanding in a direction inclined at an angle within a range of less than 45° with respect to the axial direction. Further, in the present description, to "extend or expand radially" includes not only a case of extending or expanding strictly in the radial direction, that is, in a direction perpendicular to the axial direction (Y-axis direction), but also a case of extending or expanding in a direction inclined at an angle within a range of less than 45° with respect to the radial direction. Further, the term "parallel" includes not only a case of being strictly parallel but also a case of being inclined within a range of a formed angle at less than 45°.

Figure 1:
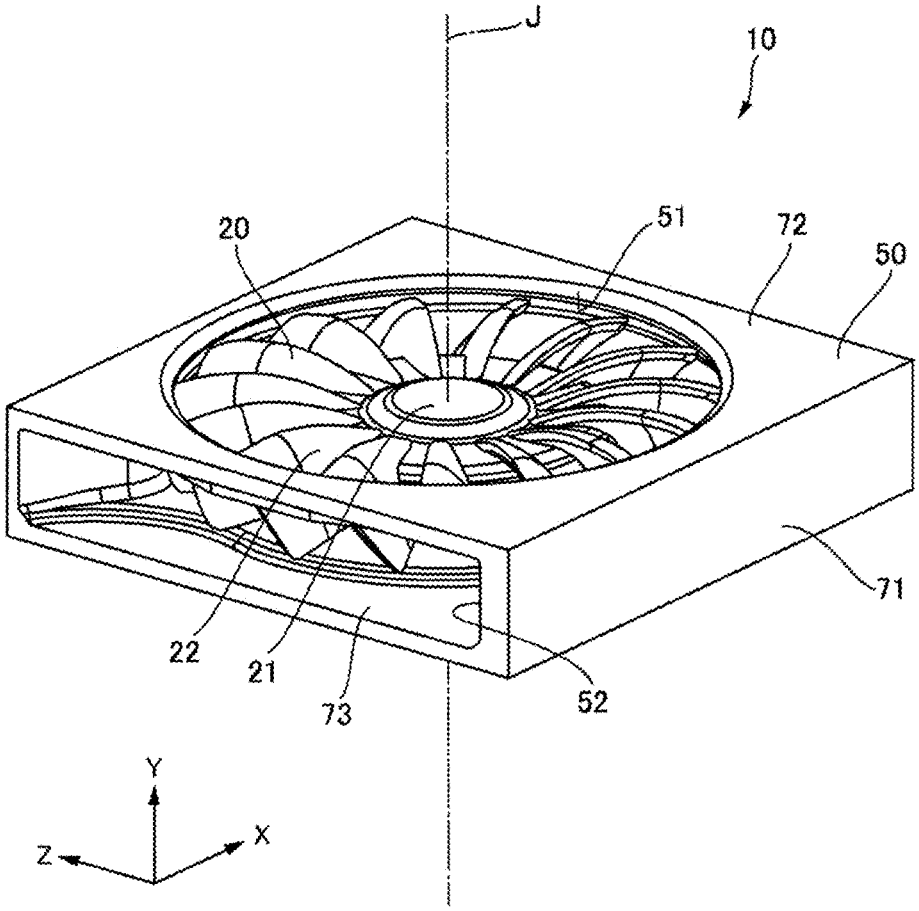
FIG. 1 is a perspective view illustrating a fan according to a first example embodiment of the present disclosure.

FIG. 1 is a perspective view of a centrifugal fan according to a first example embodiment of the present disclosure. A fan 10 is an example of the centrifugal fan.

The fan 10 has a rotation axis of a motor (not illustrated) as the central axis J. The fan 10 includes an impeller 20 that rotates about the central axis J, a motor that rotates the impeller 20, and a case 50 that houses the motor and the impeller 20. The impeller 20 includes a hub portion 21 that rotates about the central axis J and expands radially from the central axis J, and a plurality of wings 22 inclined in the circumferential direction radially outside of the hub portion 21. The case 50 has an intake port 51 and an exhaust port 52. The case 50 includes a side wall portion 71 parallel to the axial direction, an upper plate 72 orthogonal to the axial direction, and a lower plate 73 orthogonal to the axial direction. The side wall portion 71 faces at least a part of a radially outer portion of the impeller 20. The upper plate 72 faces at least a part on the first side in the axial direction of the impeller 20, and is provided with the intake port 51 around the central axis J. The lower plate 73 faces at least a part on the second side in the axial direction of the impeller 20. In the present example embodiment, the case 50 has a length of 17 mm in the X-axis direction, a length of 17 mm in the Z-axis direction, and a length of 3.5 mm in the Y-axis direction.

Figure 2:
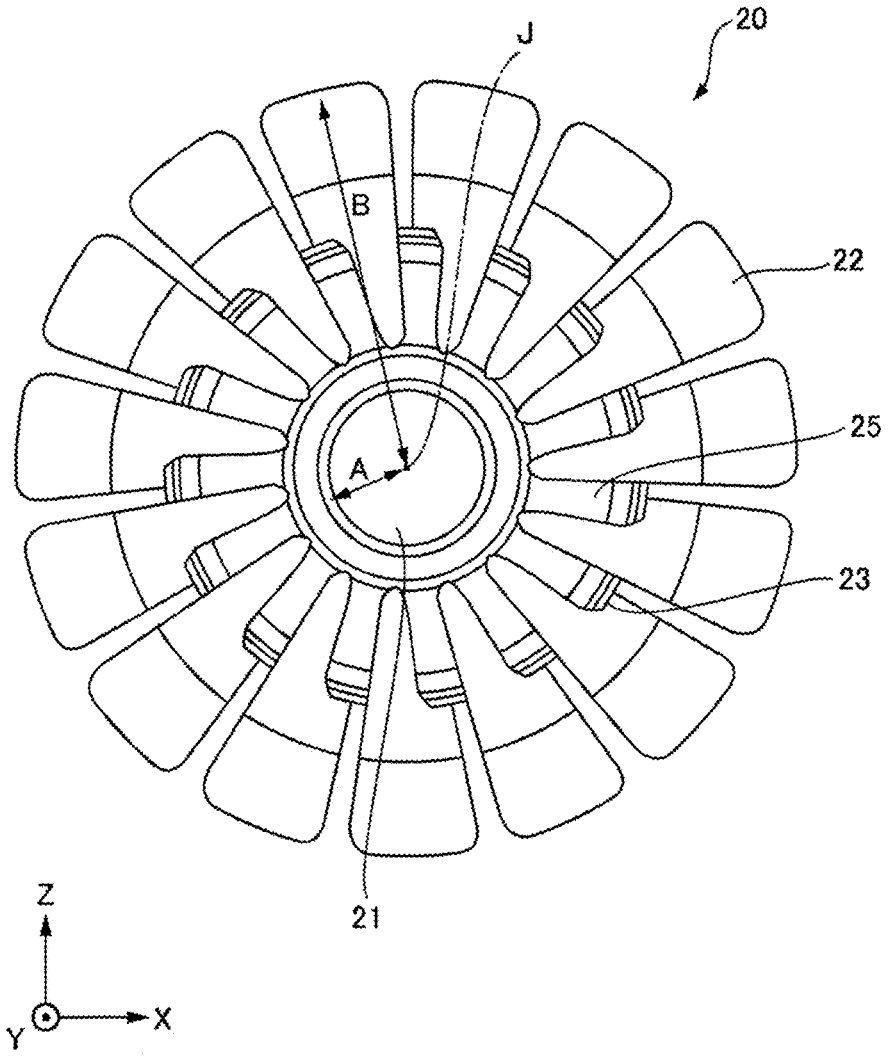
FIG. 2 is a plan view of an impeller 20 in FIG. 1.

FIG. 2 is a plan view of the impeller 20 in FIG. 1.

Figure 3:
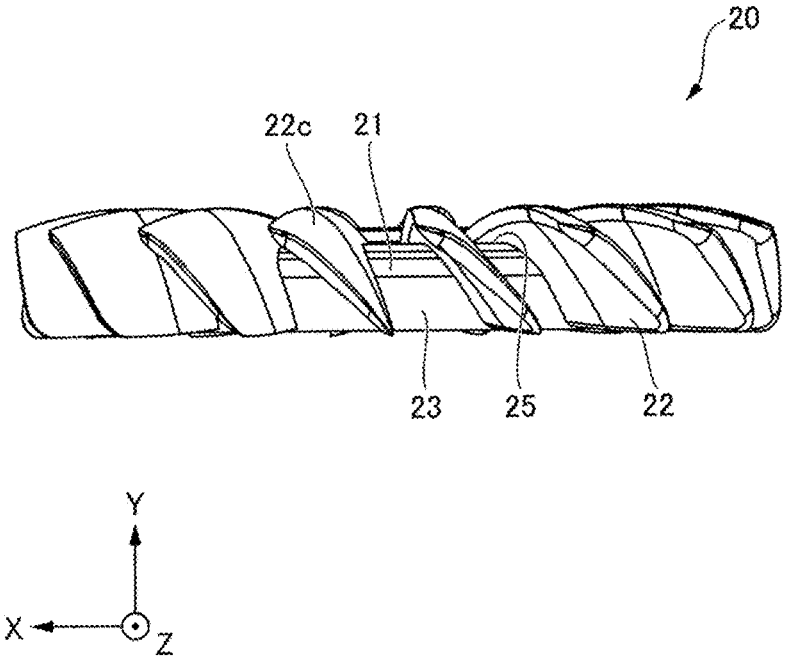
FIG. 3 is a side view of the impeller 20 in FIG. 1.

FIG. 3 is a side view of the impeller 20 of FIG. 1.

Figure 4:
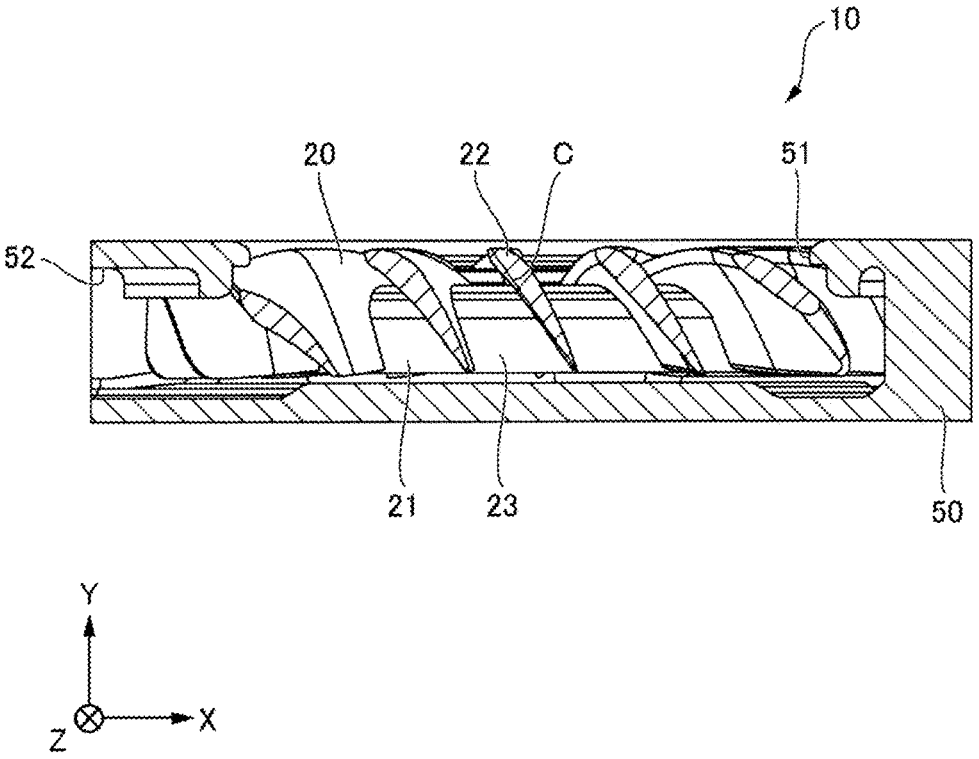
FIG. 4 is a cross-sectional view of a fan 10 according to an example embodiment of the present disclosure in a plane parallel to an axial direction at a position further on the radially outer side than an outer surface 23 of a hub portion 21 and further on the radially inner side than a radially outer end portion of a wing 22.

FIG. 4 is a cross-sectional view of the fan 10 in a plane parallel to the axial direction at a position further on the radially outer side than an outer surface 23 of the hub portion 21 and further on the radially inner side than a radially outer end portion of the wing 22.

The wing 22 is fixed to the radially outer side of the hub portion 21 provided around the axis, and at least a part of the wing 22 extends further radially outward on the first side in the axial direction than a surface 25 which is a surface on the first side in the axial direction of the hub portion 21. The wing 21 is inclined in the circumferential direction on the outer surface 23 of the hub portion 21. The wing 22 has an inclined surface 22*c* inclined with respect to the axial direction. As illustrated in FIG. 4, a cross-sectional shape of the wing 22 in the circumferential direction is a wing shape in which a front edge in a rotation direction is rounded and a rear edge is pointed. A straight line connecting an end portion on a first side in the circumferential direction and an end portion on a second side in the circumferential direction in a circumferential cross section of the wing 22 is referred to as a chord C. A distance between the chord C and a wing shape center line obtained by averaging an upper surface line and a lower surface line in the cross section of the wing 22 has a camber with a bulging shape on the first side in the axial direction. An angle formed by the chord C of the wing 22 and the axial direction is smaller in a radially inner end portion than in a radially outer end portion, and is smaller in a radially middle portion than in a radially inner end portion. That is, the wing 22 is an axial flow wing. The impeller 20 does not include a main plate that supports the wing 22 in the axial direction of the wing 22.

Here, a result of obtaining static pressure and air volume by fluid analysis for a sample having different numbers of the wings 22 and different angles formed by the chord C and the axial direction will be described.

Figures 5, 6:
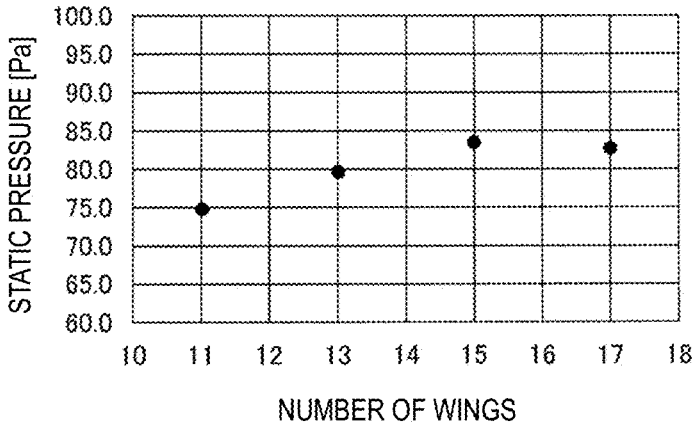
FIG. 5 is a diagram illustrating a condition for fluid analysis according to an example embodiment of the present disclosure.
FIG. 6 is a diagram illustrating static pressure obtained by fluid analysis under the condition of FIG. 5.

FIG. 5 is a diagram illustrating a conditions for fluid analysis.

FIG. 6 is a diagram illustrating static pressure obtained by fluid analysis under the condition of FIG. 5.

Figure 7:
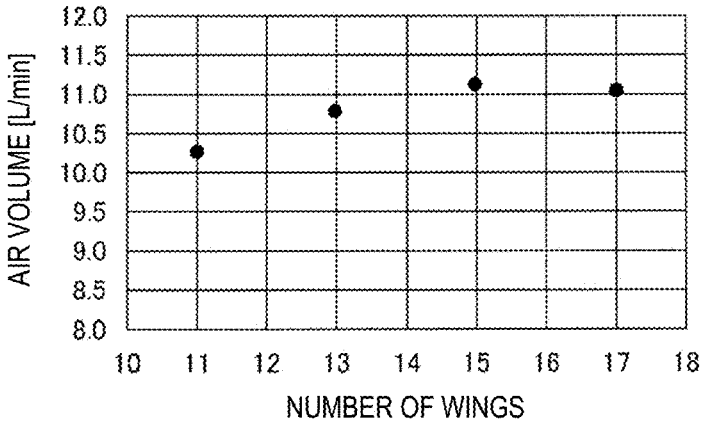
FIG. 7 is a diagram illustrating air volume obtained by fluid analysis under the condition of FIG. 5.

FIG. 7 is a diagram illustrating air volume obtained by fluid analysis under the condition of FIG. 5.

Here, as illustrated in FIG. 2, comparison is made between a position where a radial distance from the central axis J is a distance A and a position where a radial distance from the central axis J is a distance B. Here, the distance A is 1.45 mm, and the distance B is 7.25 mm.

In a first shape example, the number of the wings 22 is eleven, an angle formed by the axial direction and the chord C assumed at the position where a radial distance from the central axis J is the distance A is 15.5 degrees, and an angle formed by the axial direction and the chord C at the position where a radial distance from the central axis J is the distance B is 28.4 degrees.

In a second shape example, the number of the wings 22 is thirteen, an angle formed by the axial direction and the chord C assumed at the position where a radial distance from the central axis J is the distance A is 18.4 degrees, and an angle formed by the axial direction and the chord C at the position where a radial distance from the central axis J is the distance B is 33.2 degrees.

In a third shape example, the number of the wings 22 is fifteen, an angle formed by the axial direction and the chord C assumed at the position where a radial distance from the central axis J is the distance A is 21.5 degrees, and an angle formed by the axial direction and the chord C at the position where a radial distance from the central axis J is the distance B is 37.6 degrees.

In a fourth shape example, the number of the wings 22 is seventeen, an angle formed by the axial direction and the chord C assumed at the position where a radial distance from the central axis J is the distance A is 22.4 degrees, and an angle formed by the axial direction and the chord C at the position where a radial distance from the central axis J is the distance B is 38.9 degrees.

In FIG. 6, static pressure (here, maximum static pressure) with respect to the number of the wings 22 is illustrated. The case where the number of the wings 22 is eleven indicates static pressure of the first shape example, the case where the number of the wings 22 is thirteen indicates static pressure of the second shape example, the case where the number of the wings 22 is fifteen indicates static pressure of the third shape example, and the case where the number of the wings 22 is seventeen indicates static pressure of the fourth shape example.

In FIG. 7, air volume (here, maximum air volume) with respect to the number of the wings 22 is illustrated. The case where the number of the wings 22 is eleven indicates air volume of the first shape example, the case where the number of the wings 22 is thirteen indicates air volume of the second shape example, the case where the number of the wings 22 is fifteen indicates air volume of the third shape example, and the case where the number of the wings 22 is seventeen indicates air volume of the fourth shape example.

Referring to FIGS. 6 and 7, large maximum static pressure and large maximum air volume can be realized in any of the first shape example, the second shape example, the third shape example, and the fourth shape example.

That is, an angle formed by the chord and the axial direction at a radially inner end portion of the wing 22 is in a range of 15.5 degrees to 22.4 degrees, and an angle formed by the chord and the axial direction at a radially outer end portion is in a range of 28.4 degrees to 38.9 degrees.

Further, the number of the wings 22 is any of thirteen to seventeen.

Further, the number of the wings 22 is an odd number.

Referring to FIGS. 6 and 7, in particular, in the case of the third shape example, larger maximum static pressure and larger maximum air volume can be realized.

That is, the number of the wings 22 is fifteen.

Figure 8:
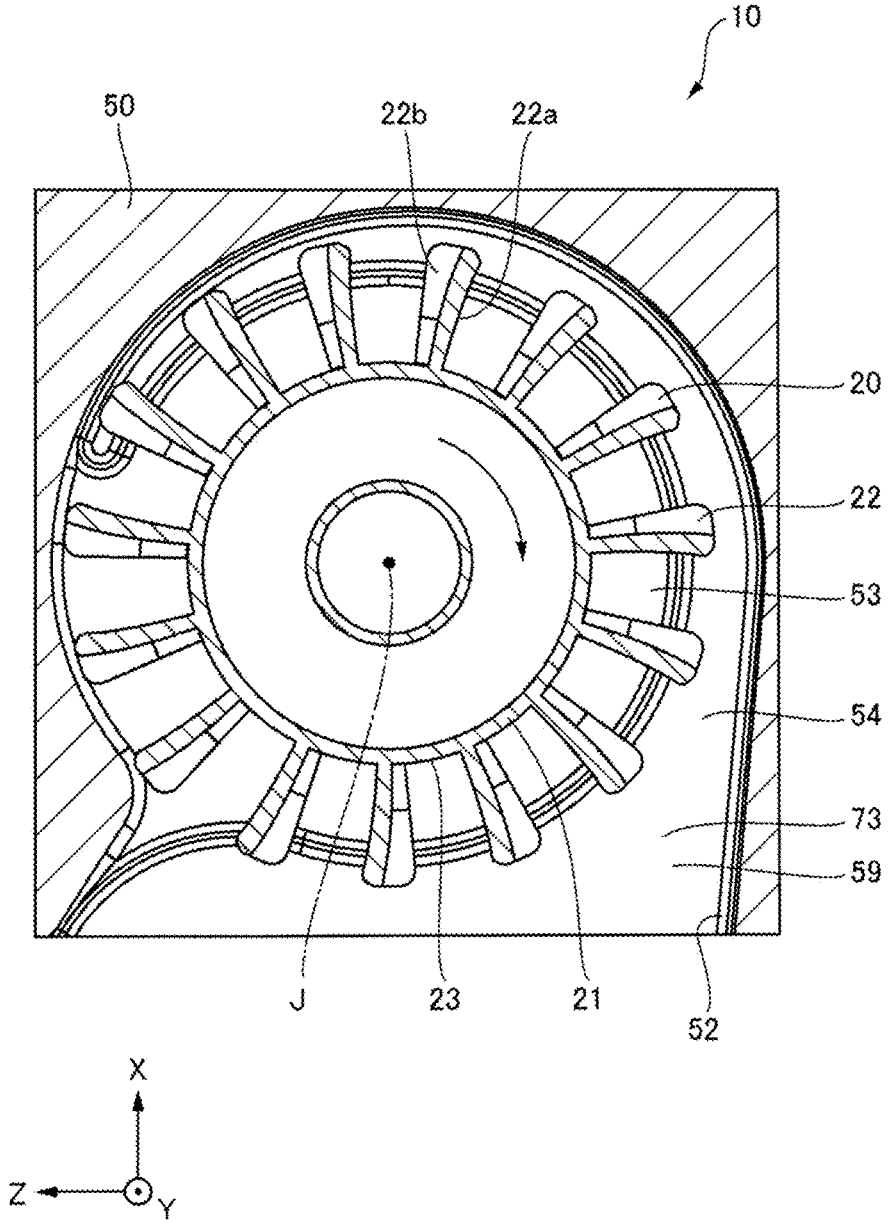
FIG. 8 is a plan cross-sectional view illustrating the fan 10 of FIG. 1 cut in a direction orthogonal to the axial direction.

FIG. 8 is a plan cross-sectional view illustrating the fan 10 of FIG. 1 cut in a direction orthogonal to the axial direction.

The impeller 20 rotates to the first side in the circumferential direction (a direction indicated by an arrow in FIG. 8). When the impeller 20 rotates to the first side in the circumferential direction, a surface 22*a* of the wing 22 becomes a positive pressure surface, and a surface 22*b* becomes a negative pressure surface. The negative pressure surface side of the wing 22 extends radially outward from the hub portion 21, and the positive pressure surface side and the negative pressure surface side of the wing 22 extend while bending more to the first side in the circumferential direction toward the radially outer side.

The lower plate 73 of the case 50 has a motor placement surface 53 on which a motor that rotates the impeller 20 is placed, and a groove portion 54 recessed more to the second side in the axial direction than the motor placement surface 53. The groove portion 54 forms a guide portion 59 that guides air blown by rotation of the impeller 20.

Figure 9:
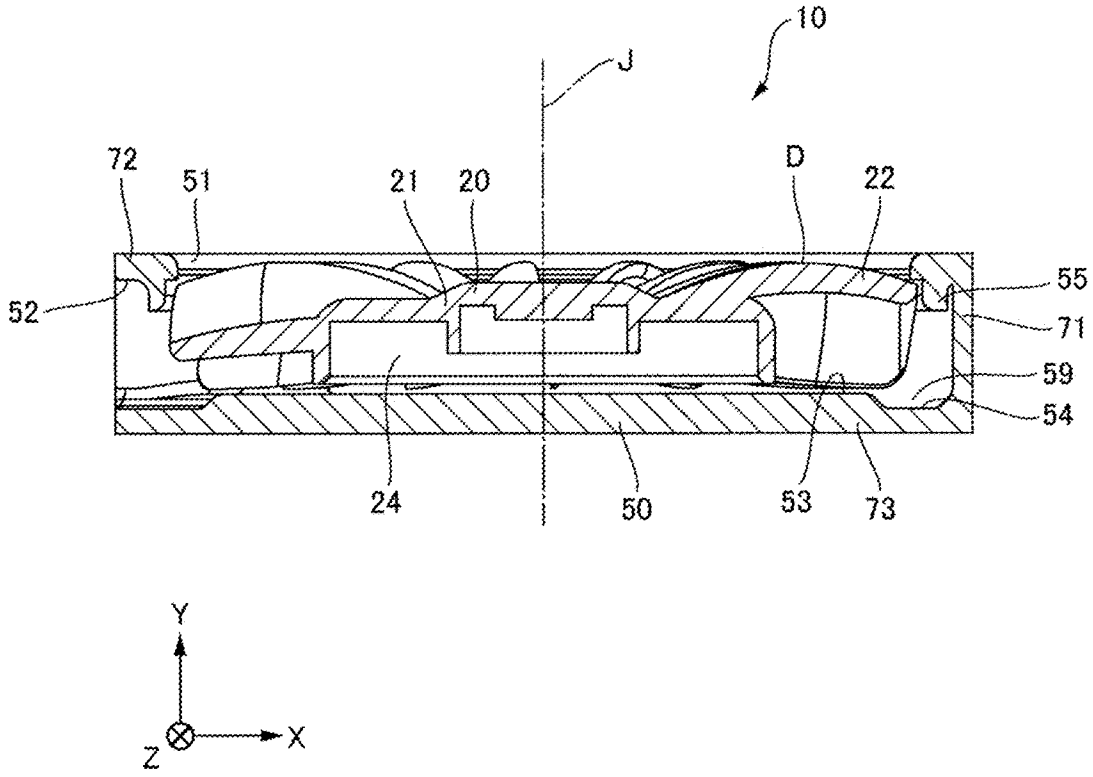
FIG. 9 is a side cross-sectional view illustrating the fan 10 of FIG. 1 cut along a plane passing through a central axis J and orthogonal to a Z axis.

FIG. 9 is a side cross-sectional view illustrating the fan 10 of FIG. 1 cut along a plane passing through the central axis J and orthogonal to the Z axis.

The impeller 20 has a motor housing portion 24 that houses a motor that rotates the impeller 20 on the second side in the axial direction.

The case 50 covers at least a part of the impeller 20 from the radially outside, and has the intake port 51 on the first side in the axial direction of the impeller 20. An end portion on the first side in the axial direction located closest to the first side in the axial direction of the impeller 20 faces at least a part of an edge portion of the intake port 51 in the radial direction.

Further, a radially outer end portion located closest to the radially outer side of the impeller 20 axially faces at least a part of an edge portion of the intake port 51. That is, the radially outer end portion of the impeller 20 is located further on the radially outer side than a radially inner end portion of an edge portion of the intake port 51.

An axial position of an end portion on the first side in the axial direction of the wing 22 smoothly changes from the radially inner side to the radially outer side. The end portion on the first side in the axial direction of the wing 22 extends in the radial direction.

At the radial position of the wing 22, the end portion on the first side in the axial direction located closest to the first side in the axial direction corresponds to a position D. An optimum position of the position D was obtained by obtaining maximum static pressure by fluid analysis for each of samples between which the position D, which is the position of the end portion on the first side in the axial direction of the wing 22, was different in the radial direction.

Figure 10:
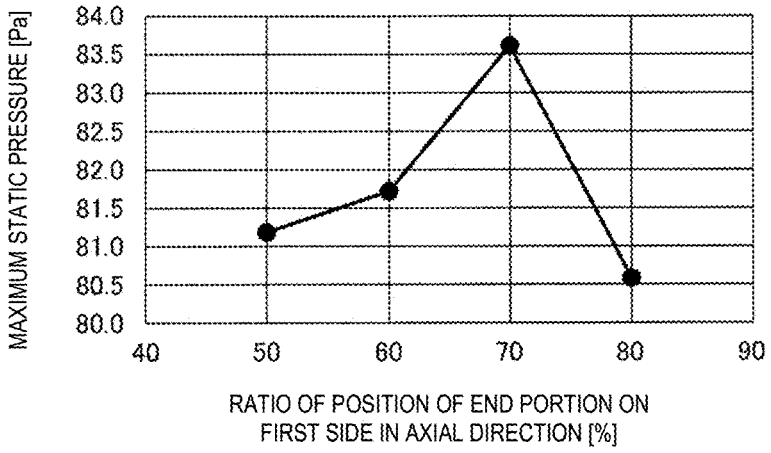
FIG. 10 is a diagram illustrating a result of obtaining maximum static pressure by fluid analysis for each ratio of a distance from a radially inner end portion of the wing 22 to a position D with respect to a distance from the radially inner end portion to a radially outer end portion of the wing 22.

FIG. 10 is a graph showing a result of obtaining maximum static pressure by fluid analysis for four samples in which ratios of a distance from a radially inner end portion to the position D to a distance from a radially inner end portion to a radially outer end portion of the wing 22 are 50%, 60%, 70%, and 80%.

As can be seen with reference to FIG. 10, large maximum static pressure can be realized at a position where the ratio of the distance from the radially inner end portion to the position D to the distance from the radially inner end portion to the radially outer end portion of the wing 22 is 60% to 70%. Therefore, the end portion on the first side in the axial direction is preferably located closest to the first side in the axial direction at the position where the ratio of the distance away from the radially inner end portion toward the radially outer side to the distance from the radially inner end portion to the radially outer end portion is 60% to 70%.

Further, as can be seen with reference to FIG. 10, largest maximum static pressure can be realized at a position where the ratio of the distance from the radially inner end portion to the position D to the distance from the radially inner end portion to the radially outer end portion of the wing 22 is 70%. Therefore, the end portion on the first side in the axial direction is preferably located closest to the first side in the axial direction at the position where the ratio of the distance away from the radially inner end portion toward the radially outer side to the distance from the radially inner end portion to the radially outer end portion is 70%.

Figure 11:
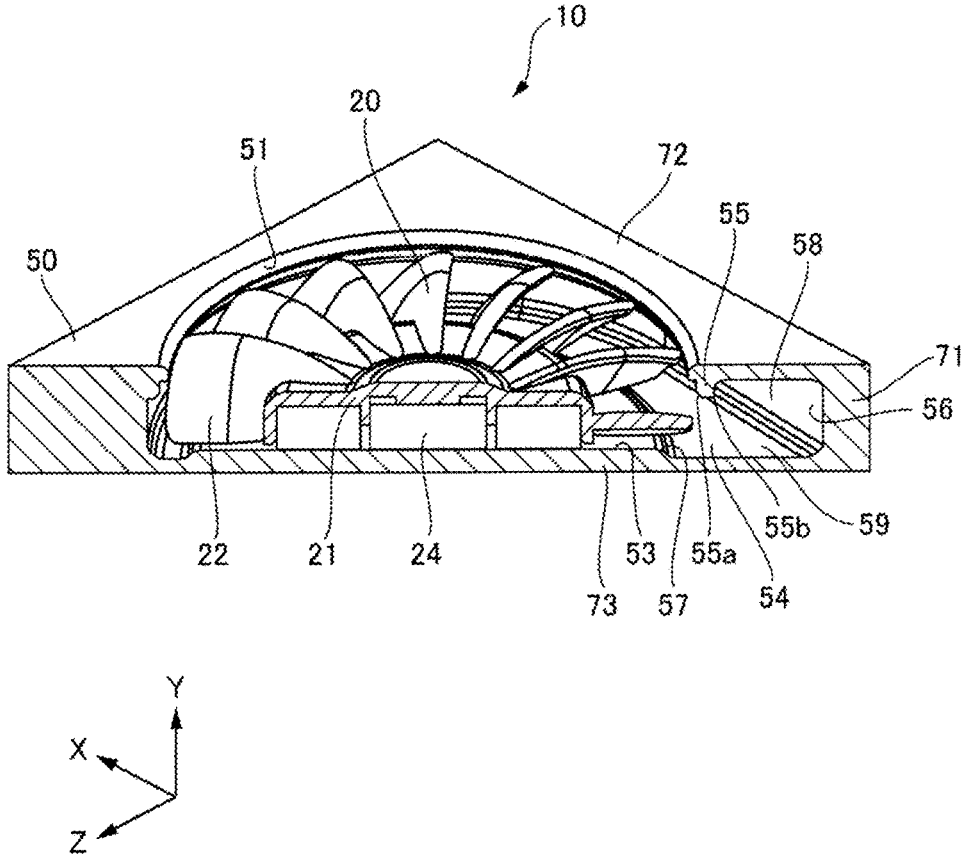
FIG. 11 is a perspective cross-sectional view illustrating the fan 10 of FIG. 1 cut along a plane parallel to the central axis J and passing through a diagonal line of an upper plate 72.

FIG. 11 is a perspective cross-sectional view illustrating the fan 10 of FIG. 1 cut along a plane parallel to the central axis J and passing through a diagonal line of the upper plate 72.

At least a part of the radially outer side of the intake port 51 has a protruding portion 55 protruding to the second side in the axial direction. The protruding portion 55 faces an outer side portion of the impeller 20 in the radial direction. That is, as can be seen with reference to FIG. 9, an axial position of a radially outer end portion of the impeller 20 is further on the first side in the axial direction than an end portion on the second side in the axial direction of the protruding portion 55. Further, an axial position of the radially outer end portion of the impeller 20 is further on the second side in the axial direction than an end portion on the first side in the axial direction of the protruding portion 55.

Further, the protruding portion 55 faces an outer surface of the wing 22 in the radial direction. That is, as can be seen with reference to FIG. 9, an axial position of a radially outer end portion of the wing 22 is further on the first side in the axial direction than an end portion on the second side in the axial direction of the protruding portion 55. Further, an axial position of the radially outer end portion of the wing 22 is further on the second side in the axial direction than an end portion on the first side in the axial direction of the protruding portion 55.

An end portion on the second side in the axial direction of the protruding portion 55 is located further on the second side in the axial direction than a surface on the first side in the axial direction of the hub portion 21. That is, for example, an axial position of the surface 25 of the hub portion 21 is located further on the first side in the axial direction than an end portion on the second side in the axial direction of the protruding portion 55.

An end portion 55*a* which is an end portion on the second side in the axial direction and on the radially inner side of the protruding portion 55 is a curved surface portion having a curved surface shape.

An end portion 55*b* which is an end portion on the second side in the axial direction and on the radially outer side of the protruding portion 55 is a corner not having a curved surface shape.

The protruding portion 55 is arranged over a part in the circumferential direction away from a radially outer end portion of the impeller 20 by a certain distance in the radial direction. An inner diameter of the protruding portion 55 is larger than an inner diameter of the intake port 51.

The case 50 includes a wind tunnel portion 58 provided between a radially outer side of the impeller 20 and the side wall portion 71. The wind tunnel portion 58 communicates with the exhaust port 52 illustrated in FIG. 1 and other drawings. A radial distance between the outer surface of the impeller 20 and an inner wall of the side wall portion 71 gradually increases along a rotation direction of the impeller 20.

The case 50 includes the guide portion 59. The guide portion 59 is arranged further on the second side in the axial direction than the wind tunnel portion 58. The guide portion 59 communicates with the wind tunnel portion 58. The guide portion 59 makes an axial distance between a bottom surface of the groove portion 54 and the wing 22 longer than an axial distance between the motor placement surface 53 and the wing 22.

A radially inner surface (a surface that is a surface of a step position between the motor placement surface 53 and the groove portion 54) 57 of the guide portion 59 is located radially inside a radially outer end portion of the impeller 20. The radially inner surface 57 of the guide portion 59 and a surface on the second side in the axial direction (a bottom surface of the groove portion 54) of the guide portion 59 are connected by a curved surface. The radially inner surface 57 is an inclined portion having an inclination that is not parallel to the axial direction.

A surface 56 which is an inner wall surface of the side wall portion 71 corresponds to an outer surface of the guide portion 59 and is located radially outside a radially outer end portion of the impeller 20. A surface on the second side in the axial direction (the bottom surface of the groove portion 54) of the guide portion 59 and the surface 56 are connected by a curved surface.

A radially outer surface of the wind tunnel portion 58 corresponds to the surface 56, and a surface on the first side in the axial direction (a surface on the second side in the axial direction of the upper plate 72) of the wind tunnel portion 58 and the surface 56 are connected by a curved surface.

A surface on the first side in the axial direction of the wind tunnel portion 58 (a surface on the second side in the axial direction of the upper plate 72) and a radially inner side surface of the wind tunnel portion 58 (a radially outer side surface of the protruding portion 55) are connected by a curved surface.

Next, a function and an effect of the impeller 20 and the fan 10 will be described.

In the disclosure according to the above-described example embodiment, there is provided an impeller for a centrifugal fan that rotates about a central axis and the central axis. The impeller includes a hub portion expanding radially outward about the central axis, and a plurality of wings provided on a radially outer side of the hub portion. A cross-sectional shape of the wing in a circumferential direction is a wing shape.

Since the cross-sectional shape is a wing shape, large air volume can be obtained.

Further, the wing has an inclined surface inclined with respect to an axial direction.

Since the inclined surface is included, large air volume can be obtained.

Further, an axial position of an end portion on the first side in the axial direction of the wing smoothly changes from the radially inner side to the radially outer side.

Since the axial position of the end portion on the first side in the axial direction smoothly changes, air flow is less disturbed, and high static pressure can be obtained.

Further, the wing is fixed to the radially outer side of the hub portion provided around the axis, and at least a part of the wing extends further radially outward on the first side in the axial direction than a surface on the first side in the axial direction of the hub portion.

Since the wing extends further to the first side in the axial direction than the hub, large air volume can be obtained.

Further, an angle formed by the chord of the wing and the axial direction is smaller on the radially inner side than on the radially outer side, and is smaller in a radially middle portion than on the radially inner side.

As an inclination increases toward the radial outside, air flow is less disturbed, and a large amount of air can flow.

Further, an angle formed by the chord and the axial direction at a radially inner end portion of the wing is in a range of 15.5 degrees to 22.4 degrees, and an angle formed by the chord and the axial direction at a radially outer end portion is in a range of 28.4 degrees to 38.9 degrees.

As described above, as an inclination gradually increases toward the radial outside, air flow is less disturbed, and a large amount of air can flow.

Further, the impeller rotates to a first side in a circumferential direction, a negative pressure surface side of the wing extends radially outward from the hub portion, and a positive pressure surface side and the negative pressure surface side extend while bending more to the first side in the circumferential direction toward the radially outer side.

For this reason, it is possible to suck a large amount of air to the negative pressure surface side and push out the air radially outward on the positive pressure surface.

Further, the wing is an axial flow wing, and the number of the wings is any of thirteen to seventeen.

For this reason, a suitable impeller can be provided in a small fan, particularly a centrifugal fan having a corner of 17 mm and a thickness of 3.5 mm.

The number of the wings is an odd number.

By using an odd number of wings, vibration and noise can be reduced.

Further, the impeller does not include a main plate that supports the wing in the axial direction of the wing.

Since the main plate is not provided, size in the axial direction can be reduced.

Further, there is provided a centrifugal fan that includes the impeller, a motor that rotates the impeller, and a case that houses the impeller and the motor.

For this reason, it is possible to provide a centrifugal fan by which high static pressure and large air volume can be obtained.

Further, the case includes an upper plate that faces at least a part on a first side in an axial direction of the impeller and includes an intake port, a side wall that faces at least a part in a radial direction of the impeller, and a lower plate that faces at least a part on a second side in the axial direction of the impeller. A wind tunnel portion provided between a radially outer side of the impeller and the side wall, and an exhaust port communicating with the wind tunnel portion are included. A radial distance between an outer side surface of the impeller and the side wall gradually increases along a rotation direction of the impeller, the lower plate includes a motor placement surface on which the motor is placed and a guide portion that communicates with the wind tunnel portion radially outside the motor placement surface, and an axial distance between the guide portion and the wing is longer than an axial distance between the motor placement surface and the wing.

For this reason, since air flow directed in the axial direction from the wing inclined in the circumferential direction can be received in the axial direction by the guide portion and can be directed radially outward at the same time, air can be efficiently sent out toward the exhaust port.

The application of a centrifugal fan including the impeller of the above-described example embodiment is not particularly limited. The centrifugal fan of the above-described example embodiment is, for example, a centrifugal fan that performs air blowing for cooling an electronic component mounted on an electronic device such as a smartphone. Each of the above-described configurations can be appropriately combined within a range consistent with each other.

Although the example embodiments of the present disclosure is described above, the present disclosure is not limited to these example embodiments, and various modifications and changes can be made within the scope of the gist thereof. These example embodiments and modifications of these are included in not only the scope and gist of the disclosure, but also the disclosure described in the scope of claims and the equivalent scope of the disclosure.

Features of the above-described example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

The invention claimed is:

1. An impeller for a centrifugal fan that rotates about a central axis extending in an axial direction, the impeller comprising:

a hub portion expanding radially outward about the central axis; and wings on a radially outer side of the hub portion; wherein a cross-sectional shape of the wings in a circumferential direction is a wing shape;

the wings are fixed to a radially outer side of the hub portion provided around the central axis;

at least a portion of the wings extends radially outward farther on a first side in the axial direction than a surface on the first side in the axial direction of the hub portion;

an upper end of the wings in the axial direction is located closer to the first side in the axial direction than an upper end of the hub portion in the axial direction is;

the impeller does not include any main plate that supports the wings in an axial direction of the wings;

an axial position of an end portion on a first side in the axial direction of the wings changes from a radially inner side to a radially outer side; and a ratio of (i) a distance from a radially innermost end portion of the wings to an axially uppermost portion of the wings to (ii) a distance from the radially innermost end portion of the wings to a radially outermost end portion of the wings is equal to: 60% to 75%.

2. The impeller according to claim 1, wherein the wings include a surface inclined with respect to the axial direction.

3. The impeller according to claim 1, wherein an angle defined by a chord of the wings and the axial direction is smaller on a radially inner side than on a radially outer side and is smaller in a radially middle portion than on the radially inner side.

4. The impeller according to claim 3, wherein an angle defined by the chord and the axial direction in a radially inner end portion of the wings is in a range of about 15.5 degrees to about 22.4 degrees; and an angle defined by the chord and the axial direction in a radially outer end portion is in a range of about 28.4 degrees to about 38.9 degrees.

5. The impeller according to claim 1, wherein the impeller rotates to a first side in a circumferential direction;

a negative pressure surface side of the wings extends radially outward from the hub portion; and a positive pressure surface side and the negative pressure surface side extend while bending more to the first side in the circumferential direction toward the radially outer side.

6. The impeller according to claim 1, wherein the wings are axial flow wings; and a total number of the wings is any of thirteen to seventeen.

7. The impeller according to claim 6, wherein the total number of the wings is an odd number.

8. A centrifugal fan comprising:

the impeller according to claim 1;

a motor to rotate the impeller; and a case that houses the impeller and the motor.

9. The centrifugal fan according to claim 8, wherein the case includes an upper plate that opposes at least a portion of the impeller on a first side in an axial direction and includes an intake port, a side wall that opposes at least a portion of the impeller in a radial direction, and a lower plate that opposes at least a portion of the impeller on a second side in the axial direction, the centrifugal fan further comprising:

a wind tunnel portion between a radially outer side of the impeller and the side wall; and an exhaust port communicating with the wind tunnel portion;

a radial distance between an outer side surface of the impeller and the side wall increases along a rotation direction of the impeller;

the lower plate includes a motor placement surface on which the motor is placed and a guide portion that communicates with the wind tunnel portion radially outside the motor placement surface; and an axial distance between the guide portion and the wings is longer than an axial distance between the motor placement surface and the wings.

* * * * *